US005848669A

United States Patent [19]

Park

[11] Patent Number: 5,848,669

[45] Date of Patent: Dec. 15, 1998

[54] APPARATUS FOR EFFICIENTLY MANAGING A PLURALITY OF ELEVATORS

[75] Inventor: Jong Hun Park, Kwangmyung, Rep. of Korea

[73] Assignee: LG Industrial Systems Co., Ltd, Seoul, Rep. of Korea

[21] Appl. No.: 743,155

[22] Filed: Nov. 4, 1996

[30] Foreign Application Priority Data

Nov. 8, 1995 [KR] Rep. of Korea ..... 1995 40214

[51] Int. Cl.[6] ..... B66B 1/28

[52] U.S. Cl. ..... 187/247; 187/391

[58] Field of Search ..... 187/247, 248, 187/380, 391, 393, 382

[56] References Cited

U.S. PATENT DOCUMENTS

| | | | |
|---|---|---|---|
| 4,436,185 | 3/1984 | Ludwig et al. | 187/29 R |
| 4,497,391 | 2/1985 | Mendelsohn et al. | 187/29 R |
| 4,567,560 | 1/1986 | Polis et al. | 364/184 |
| 4,594,570 | 6/1986 | Tweed, Jr. et al. | 340/21 |
| 4,683,989 | 8/1987 | Pillage et al. | 187/121 |
| 4,844,204 | 7/1989 | Ovaska et al. | 187/101 |
| 5,202,540 | 4/1993 | Auer et al. | 187/101 |
| 5,306,878 | 4/1994 | Kubo | 187/127 |
| 5,360,952 | 11/1994 | Brajczewski et al. | 187/246 |
| 5,654,531 | 8/1997 | Farbee et al. | 187/247 |
| 5,736,692 | 4/1998 | Lumme et al. | 187/247 |

*Primary Examiner*—Robert Nappi
*Attorney, Agent, or Firm*—Oliff & Berridge, PLC

[57] ABSTRACT

An apparatus for efficiently managing a plurality of elevators in a group management apparatus in which input and output devices that are mutually related are combined into one group and connected as a network, which does not require any complicated wiring and thus the utilized equipment, repairing and maintenance of the overall elevator system are simplified. The input and output signals are dispersed to each node and each elevator controller to be processed, thereby enhancing the efficiency of the elevator controller which includes a hall subnetwork serially connecting one hall node on each floor to a group management node, an elevator subnetwork connecting an elevator node and a elevator node in each elevator, and a router for logically/electrically separating the hall subnetwork and the elevator subnetwork, thereby preventing a failure of the elevator or a failure on the network connecting hall nodes or a failure on the elevator subnetwork from affecting the entire group management network to enhance the overall elevator system reliability.

2 Claims, 6 Drawing Sheets

APPARATUS FOR EFFICIENTLY MANAGING A PLURALITY OF ELEVATORS

BACKGROUND OF THE INVENTION

1. Field of the Invention

The present invention relates to an apparatus for managing a plurality of elevators, and more particularly, to an improved apparatus for efficiently managing a plurality of elevators which is capable of enhancing the efficiency of the entire elevator system by combining the input/output devices having a local interrelation into respective groups, then connecting these as a network and controlling the input and output operations on each floor, respectively.

2. Description of the Prior Art

Conventionally, in an elevator system having a plurality of elevators, the efficiency of the overall elevator system, the requirements depending on the user's desires and operation reliability not only depend upon the number of elevators, the speed of each elevator and the number of floors in the building, but also the network structure of how the elevators are controlled is crucial.

As shown in FIG. 1, a conventional elevator system includes: a hall input/output (I/O) unit 1 for controlling the indication lamps showing the arrival of an elevator in response to the elevator call request signals made by passengers who press elevator call buttons on various floors in a building; an elevator input/output (I/O) unit 2 which registers the destination floors selected by the passengers on board the elevator and shows the current floor and moving direction of the elevator under operation; a group management control unit 3 which specifically designates an appropriate elevator to respond to a particular elevator call request for maximizing the overall elevator system operation efficiency; and an elevator control unit 4 which controls the motors and doors of the elevators to serve the call requests according to operation sequences when the appropriate elevators are designated.

The hall I/O unit 1 includes an indicator for informing to passengers waiting on each floor the present location and proceeding direction of each elevator; a hall call button used by the passengers on each floor of a building to request an elevator; a hall call registration lamp for showing a hall call registration; and an arrival forecasting lamp to inform the passenger waiting on a floor of the arrival of an elevator.

The elevator I/O unit 2 includes an indicator for informing the present location and proceeding direction of the elevator to the passenger in the elevator, floor buttons for registering the destination floor requested by the passenger, and floor registration lamps for indicating the destination floor.

The group management controller 3 and the elevator controller 4 are connected by a series communication line while the other elements are connected by a parallel communication line.

The operation of a conventional elevator system will now be described in detail.

First, when a passenger waiting on a certain floor pushes the hall call buttons of the hall I/O unit 1 to request an elevator, the hall I/O unit 1 registers such request in the group management controller 3 through the parallel communication line, and turns on the hall call registration lamp.

The group management controller 3 evaluates various conditions such as the passenger's waiting time and the energy efficiency considering the registered hall call, the elevator call, and the current operation state of each elevator. A particular elevator among a plurality of elevators is determined to be optimal, for example, the elevator requiring the least amount of energy in sending to and is closest to the floor at which the passenger is waiting, and such elevator is sent in response to the requested call. Here, an exchange of information between each elevator and the group management controller 3 is carried out through a series communication line.

When the requested hall call is designated to a specific elevator, the elevator controller 4 controls the motor and sends the elevator to the corresponding floor in accordance with the operation sequence to respond to the corresponding hall call.

Here, as the speed of the elevator is reduced just prior to arrival at the destination floor, the elevator controller 4 activates the arrival indication lamp of the hall I/O unit 1 through the parallel communication line to show that the elevator is arriving. When the elevator arrives at the destination floor, the door of the elevator is opened for a predetermined time to allow passengers to exit and board.

Next, when the passengers boarding the elevator register their destinations by pushing the appropriate destination floor buttons in the elevator, the elevator I/O unit 2 registers the selected floors in the elevator controller 4 through the parallel communication line, and turns on the elevator call registration lamps corresponding to the selected floors.

Thus, when the selected floors are registered, the elevator controller 4 controls a sequence of operations for letting off passengers on the nearest selected floor in the presently proceeding direction of the elevator. The elevator I/O unit 2 receives information from the elevator controller 4 to show the present location and proceeding direction of the elevator.

Here, the elevator controller 4 carries out the elevator call request, checks the elevator call button switch and the safety switch, and controls the output lamp and the relay switch.

When the elevator arrives at the requested destination floor, the door is opened and the requested floor button lamp of the elevator I/O unit 2 is turned off.

However, since in the conventional elevator system the I/O for controlling the elevator is performed through parallel communication lines, an elevator controller 4 must be individually provided on each floor and the costs of equipment, wiring, and repairing is disadvantageously increased if there are many floors in the building.

Further, since the elevator controller supervises and controls input and output period much longer in comparison with the control period, the efficiency of the elevator controller is decreased and the local failure of each controlling unit can affect the operation of the entire elevator system.

SUMMARY OF THE INVENTION

Accordingly, it is an object of the present invention to provide an improved apparatus for efficiently managing a plurality of elevators which is capable of maximizing the performance of an elevator controller regardless of the number of floors in the building and the number of elevators, and as a result having a fail-proof and a wide application by providing a hall node processor for managing hall inputs and outputs on each floor and a elevator node processor for managing elevator input and output to one elevator, and by connecting them to the elevator controller and then connecting a plurality of elevator controllers with a group management controller to form one network.

It is another object of the present invention to provide an improved apparatus for efficiently managing a plurality of elevators to be capable of preventing a local failure from affecting the entire group management network, by forming a hall subnetwork connecting one hall node on each floor in series with a group management node, forming an elevator subnetwork connecting an in-cage controller node and a car controller node, then by logically and electrically separating the hall subnetwork and the elevator subnetwork.

To achieve the above object, there is provided an improved apparatus for efficiently managing a plurality of elevators in which the elevator subnetwork is connected to the hall subnetwork by a router having a pair of communication CPUs and an interface device to reciprocate signals through the communication CPUs, thereby logically/electrically separating the hall subnetwork from the elevator subnetwork.

To alternatively achieve the above object, there is provided an improved apparatus for efficiently managing a plurality of elevators in which the group management node and each in-cage controller node are connected by a group management subnetwork and the hall subnetwork is connected to the elevator subnetwork and group management subnetwork by first and second routers, respectively, including a pair of communication CPUs and an interface device to reciprocate signals through the communication CPUs.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE PREFERRED EMBODIMENTS

Figure 1:
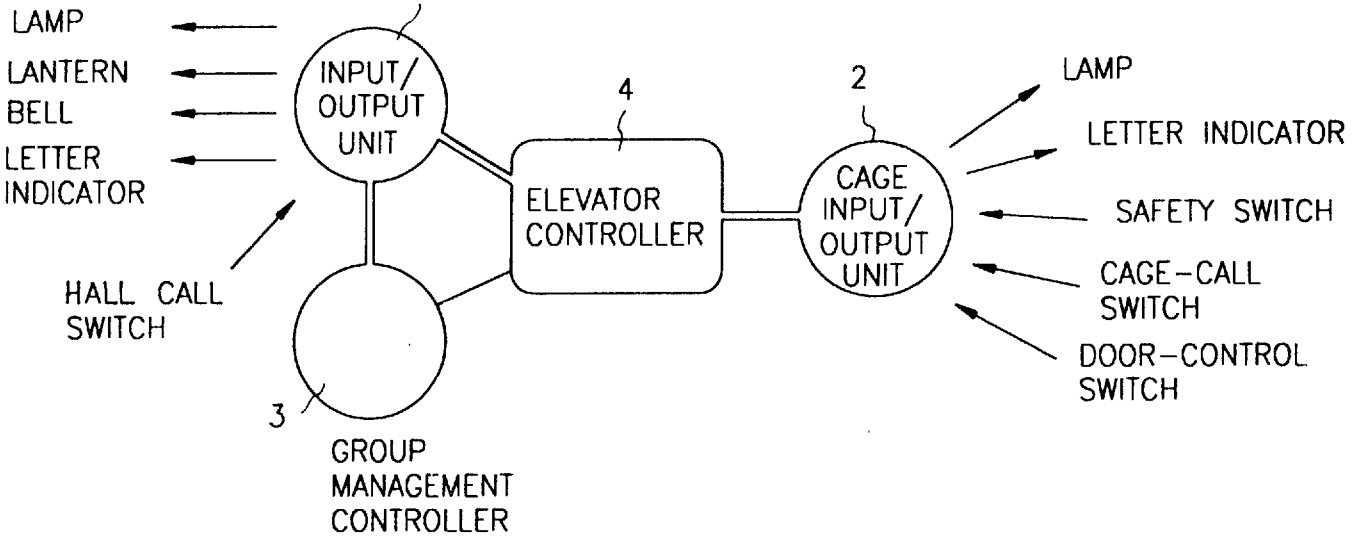
FIG. 1 CONVENTIONAL ART
FIG. 1 is a block diagram showing an elevator system according to the conventional art.
Figure 2:
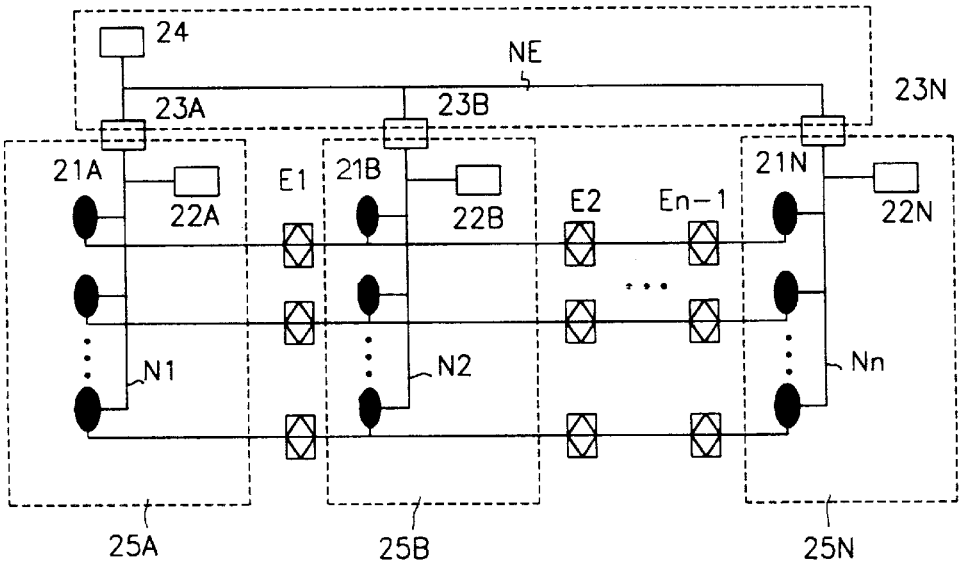
FIG. 2 is a view showing an apparatus for controlling an elevator system according to the present invention that is fail-proof and has a wide application.

FIG. 2 is a view showing an apparatus for controlling an elevator system with a fail proof and a wide application according to the present invention. The apparatus includes hall nodes 21A–21N which serve as I/O devices for registering elevator calls from passengers waiting on a floor and controlling the operation of arrival lamps lamp which indicate the arrival of an elevator; elevator nodes 22A–22N for registering a destination of the passengers boarding an elevator and indicating the present proceeding direction and location; car controller nodes 23A–23N for controlling a motor and a door in accordance with an operation sequence of the elevator; a group management node 24 for allocating an elevator according to a corresponding hall call to optimize operation efficiency of the entire elevator system; an elevator control network (N1-Nn) for connecting the hall nodes 21A–21N and the in-cage controller nodes 22A–22N to the car controller nodes 23A–23N; and a group management network (NE) for connecting the car controller nodes 23A–23N to the group management node 24.

Here, reference numerals E1 to En-1 represent common hall call circuits, and 25A–25N represent elevators.

Figure 3:
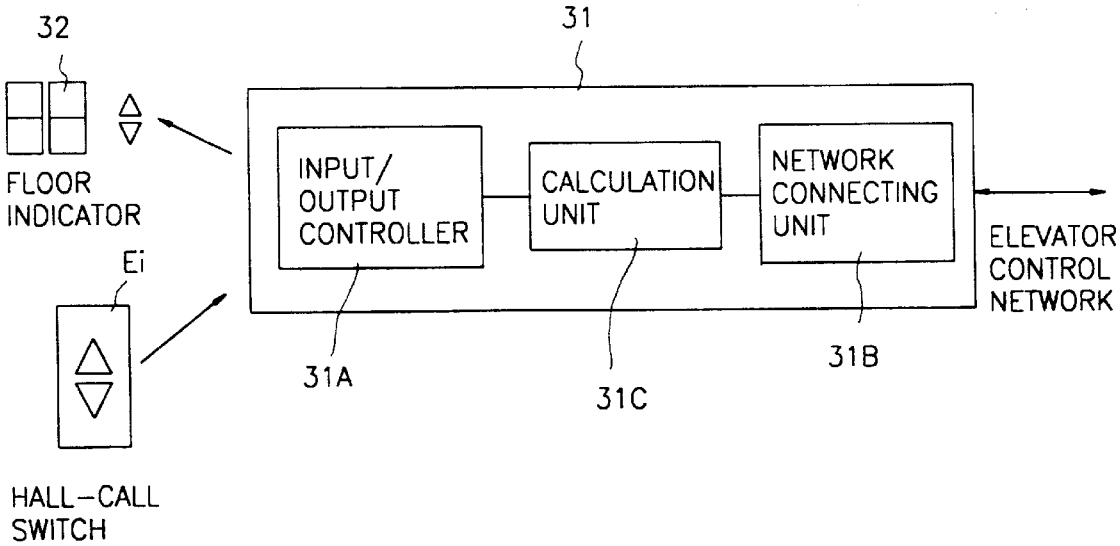
FIG. 3 is a detailed block diagram of a hall node in FIG. 2.

FIG. 3 shows a construction of one hall node 31 among the plurality of hall nodes 21A–21N. The hall node 31 includes an I/O controller 31A for operating various I/O signals of a corresponding hall (hall call button and lamp signals, an arrival indication lamp signal, a direction lamp signal, and indication of the present location of an elevator); a network connecting unit 31B connected to the car controller nodes 23A–23N through the elevator control networks (N1-Nn); and a calculation unit 31C for exchanging and processing information between the I/O controller 31A and the network connecting unit 31B.

Figure 4:
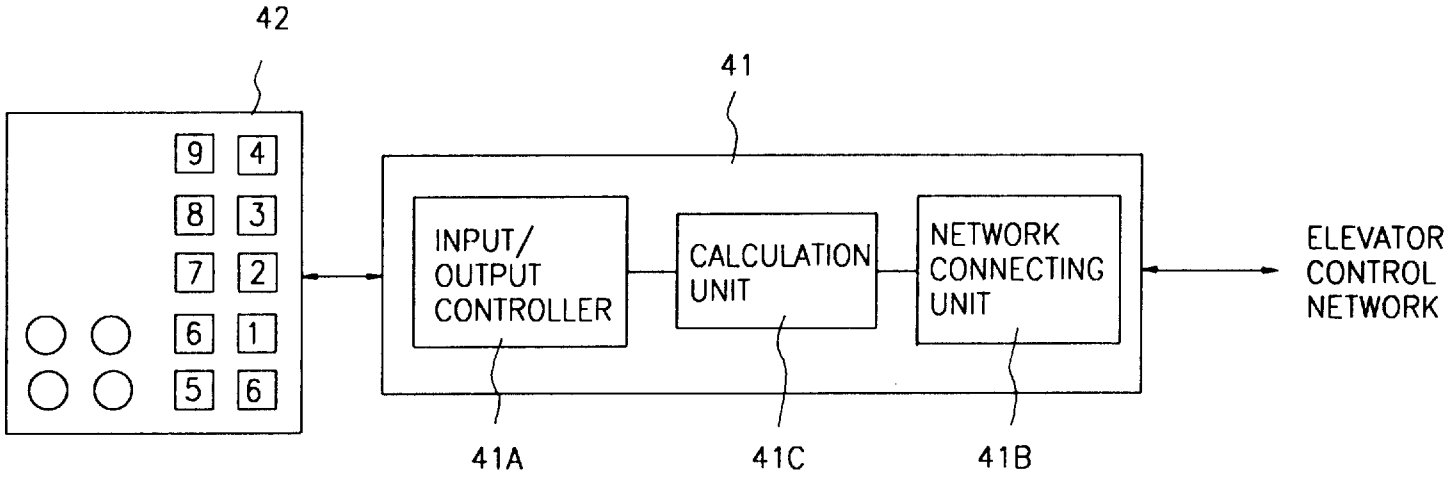
FIG. 4 is a detailed block diagram of an elevator in-cage controller node in FIG. 2.

FIG. 4 shows a construction of one in-cage controller node 41 among a plurality of in-cage controller nodes 22A–22N in FIG. 2. The in-cage controller node 41 includes an I/O controller 41A for operating various I/O signals of the elevator (elevator call button and lamp signals, a direction lamp signal, the present location signal of the elevator, the elevator opening button and lamp signals, and the elevator closing button and lamp signals); a network connecting unit 41B connected to the car controller nodes 23A–23N through the elevator controlling networks (N1-Nn); and a calculation unit 41C for exchanging and processing information between the I/O controller 41A and the network connecting unit 41B.

Figure 5:
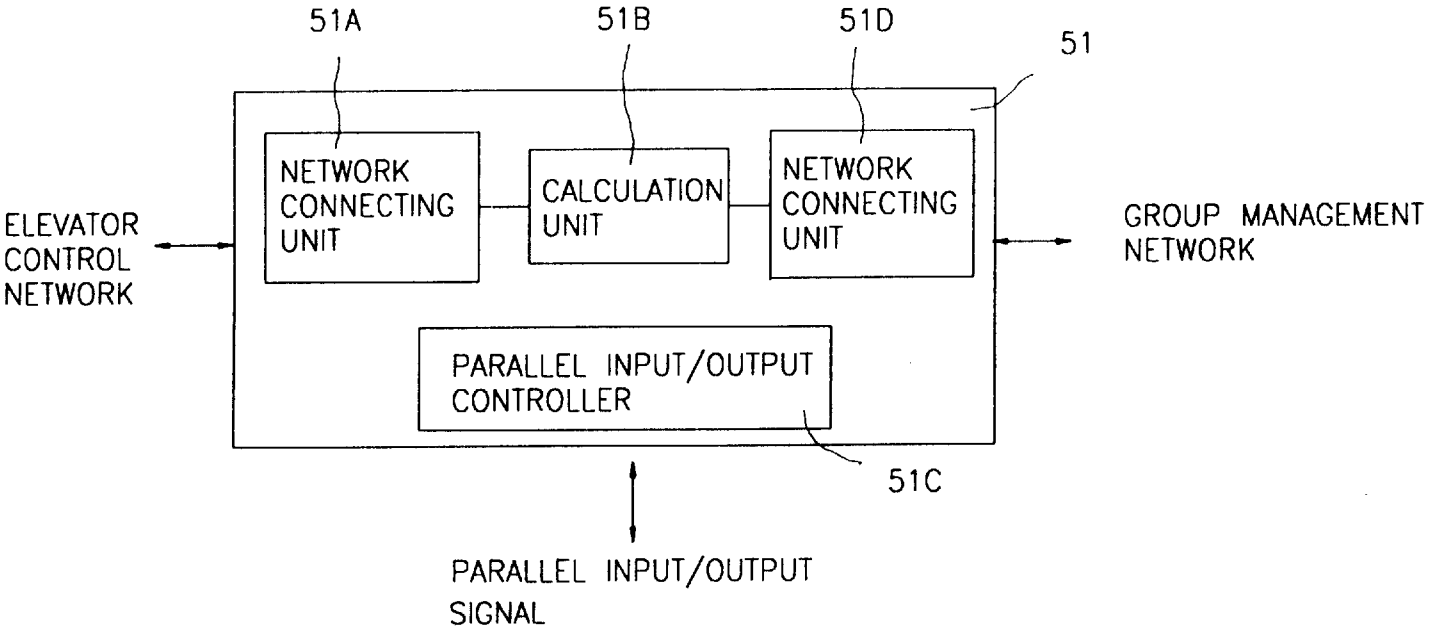
FIG. 5 is a detailed block diagram of an car controller node in FIG. 2.

FIG. 5 shows a construction of one car controller node 51 among the plurality of the car controller nodes 23A–23N. The car controller node 51 includes a network connecting unit 51A for connecting the in-cage controller nodes 22A–22N and the hall nodes 21A–21N on each floor through the elevator control networks (N1-Nn); a calculation unit 51B for performing various operations and I/O in accordance with the operation sequence of the elevator; a parallel I/O controller 51C for controlling power and relay I/O of the safety system; and a network connecting unit 51D connected to the group management node 24 through the group management network (NE).

Figure 6:
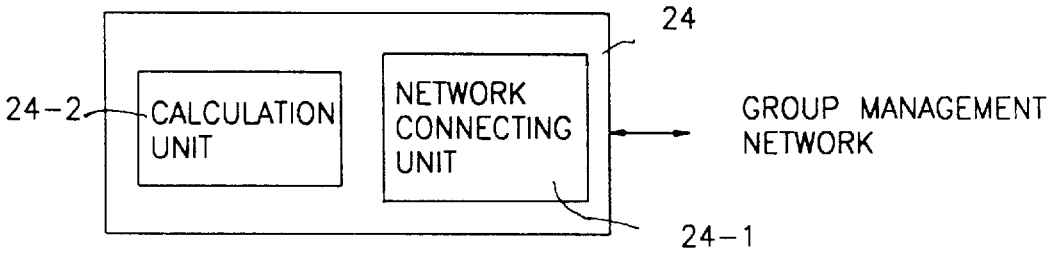
FIG. 6 is a detailed block diagram of a group management node in FIG. 2.

FIG. 6 shows the group management node 24 in FIG. 2 which includes a network connecting unit 24-1 connected to the car controller nodes 23A–23N through the group management network (NE); and a calculation unit 24-2 for performing various operations to allocate an optimum elevator to the hall call.

The operation of the present invention will now be described in detail.

First, in each elevator 25A–25N, when the location and proceeding direction of the elevator are changed, the hall nodes 21A–21N disposed on each floor receive a corresponding information from the car controller nodes 23A–23N through the elevator control networks (N1-Nn) to indicate the elevator location and moving direction on a floor indicator 32.

Here, the common hall call circuits (E1-E(n-1)) are connected to the hall nodes on the same floor so that all elevators can recognize the hall call when a specific hall call occurs.

If passengers waiting on each floor register a hall call by pushing a hall call button 33, the hall call is registered in the group management node 24 through the elevator control network (N1-Nn) and the group management network (NE).

Here, the hall call registration lamp in the hall call button 33 is lit, and then the arrival indication lamp is turned on when the elevator is near the destination floor to respond to the hall call, and the arrival indication lamp is turned off when the elevator arrives.

For the above operation, the I/O controller 31A of the hall node 31 operates various input signals of the hall (hall call button and lamp, an arrival forecasting lamp, a direction lamp, the present location signal of the elevator), and the network connecting unit 31B carries out a connection between the in-cage controller nodes 23A–23N and the elevator control networks (N1-Nn), and the calculation unit 31C exchanges and processes information between the I/O controller 31A and the network connecting unit 31B.

When the passenger requests an elevator and a hall call is registered, the group management node 24 receives such information and the current operation state of each elevator via the elevator control network (N1-Nn) and the group management network (NE), to evaluate the waiting time and energy efficiency to determine the most optimal elevator based on the above information.

The optimum elevator is selected among a plurality of elevators in response to the requested hall call and control signals are sent to the selected elevator through the elevator control network (N1-Nn) and the group management network (NE).

The network connecting unit 24-1 of the group management node 24 receives such control information, for example, the present location and the floor above the elevator, the opening and closing condition of the doors, failure of the doors, or the condition of the hall and elevator calls, from each elevator through the group management network (NE), and commands the optimum elevator to respond to the hall call. Here, the calculation unit 24-2 carries out various calculations necessary for selecting the optimum elevator in response to the hall call.

Then, when the requested hall call is allocated to a specific elevator through group management, the car controller node 23A–23N controls the motor in accordance with the set operation sequence and moves the elevator towards the destination floor.

Here, when the elevator begins to reduce speed to arrive at the destination floor, the car controller nodes 23A–23N control the arrival indication lamp of the hall nodes 21A–21N through the elevator control network (N1-Nn) to inform the passengers waiting that the elevator is arriving.

Then when the elevator arrives at the destination floor, the door is opened for a predetermined time to pick up the passengers.

The network connecting unit 51A of the car controller nodes 23A–23N connect the in-cage controller nodes 22A–22N and the hall nodes 21A–21N on each floor through the elevator control networks (N1-Nn), and the calculation unit 51B carries out various inputs/output operations in accordance with the operation sequence of the elevator.

The parallel I/O controller 51C controls the operation of the motor for moving the elevator and opening/closing the doors, and controlling the relay I/O of power and controlling the safety system, and the network connecting unit 51D transmits the present condition of the elevator and the hall, and the elevator calls through the group management network (NE) to the group management node 24.

When the passenger boarding the elevator registers a elevator call by pushing a destination floor button mounted on a call registration panel 42, the elevator call is registered on the car controller nodes 23A–23N through the control networks (N1-Nn).

When the elevator call is registered, the elevator call registration lamp of the in-cage controller nodes 22A–22N is lit, and the car controller nodes 23A–23N control the operation sequence so that the passengers get off at the nearest requested floor according to the currently proceeding direction of the elevator. The elevator nodes 22A–22N receive the information from the car controller nodes 23A–23N through the elevator control networks (N1-Nn) and the group management network (NE) whenever the present location and proceeding direction of the elevator are changed.

The I/O controller 41A of the in-cage controller node 41 operates various I/O signals (elevator call button and lamp signals, a direction lamp signal, the present location signal of the elevator, elevator opening button and lamp signals, and elevator closing button and lamp signals), and the network connecting unit 41B performs a connection between the car controller nodes 23A–23N and the elevator control network (N1-Nn), and the calculation unit 41C processes and exchanges the information between the I/O controller 41A and the network connecting unit 41B.

Then when the elevator arrives at the destination floor, the door is opened and the elevator call registration lamp of the in-cage controller nodes 22A–22N is turned off.

Figure 7:
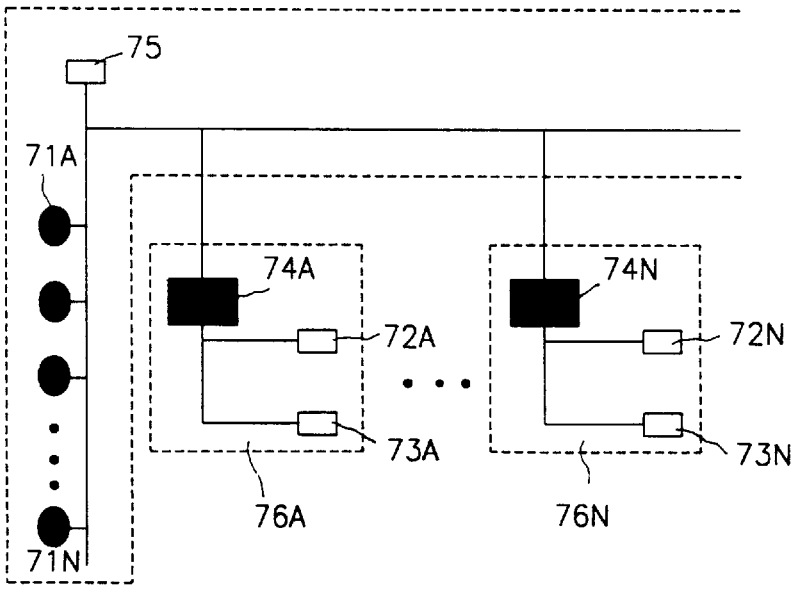
FIG. 7 is an embodiment showing an apparatus for controlling an elevator system according to the present invention that is fail-proof and has a wide application

FIG. 7 is an embodiment showing an apparatus for controlling an elevator system that is fail-proof and has a wide application according to the present invention, which includes: a hall subnetwork 77 connecting hall nodes 71A–71N and a group management node 75 dispersed in each elevator; and elevator subnetworks 76A–76N connecting car controller nodes 72A–72N and elevator nodes 73A–73N for each elevator. Here, the hall subnetwork 77 and the elevator subnetworks 76A–76N are connected through routers 74A–74N.

Figure 8:
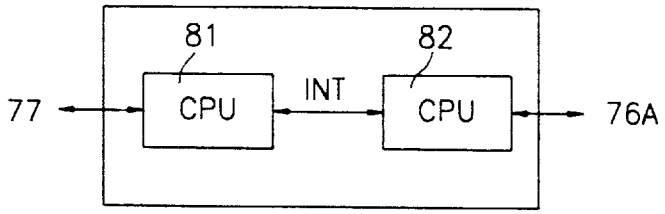
FIG. 8 is a detailed block diagram of a router in FIG. 7.

As shown in FIG. 8, the routers 74A–74N are respectively connected to the hall subnetwork 77 and the elevator subnetwork 76A–76N through central processing units (CPU) 81,82 and a microprocessor interface (INT).

That is, the function of each hall node 71A–71N, each car controller node 72A–72N and each in-cage controller node 73A–73N is the same as in FIG. 2. The hall nodes mounted in each elevator 25A–25N are combined to provide one hall node for each floor to manage the input and output operations of each floor, and the hall nodes 21A–21N on each floor are connected to the group management network 24 to enhance overall elevator system operation for maximum efficiency.

Through the routers 74A–74N, the hall subnetwork 77 and the elevator subnetworks 76A–76N are connected to exchange information therebetween, but the two networks are electrically separated to prevent the failure of one elevator or one elevator control network from affecting the entire group management network.

Figure 9:
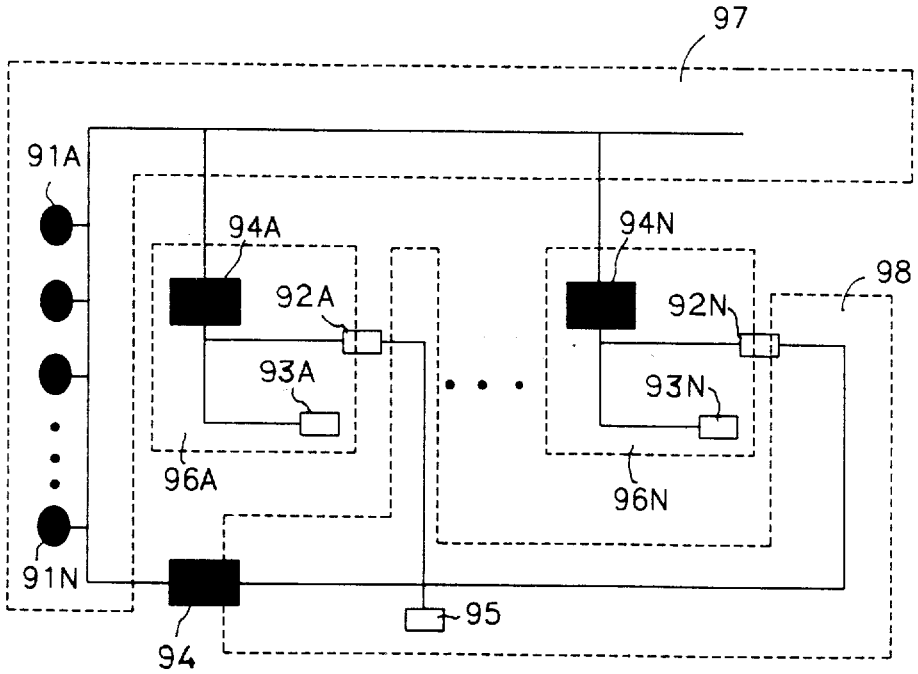
FIG. 9 is another embodiment showing an apparatus for controlling an elevator system according to the present invention that is fail-proof and has a wide application.

FIG. 9 is another embodiment showing an apparatus for controlling an elevator system according to the present invention which is fail-proof and has a wide application, which includes: a hall subnetwork 97 connecting hall nodes 91A–91N; elevator subnetworks 96A–96N connecting car controller nodes 92A–92N; and in-cage controller nodes 93A–93N in each elevator, and a group management subnetwork 98 connecting a group management node 95 and each car controller node 92A–92N.

Here, the hall subnetwork 97 is connected to the elevator subnetworks 96A–96N through routers 94A–94N and to the group management subnetwork 98 through a router 94.

That is, the hall nodes separated in each elevator are combined to provide a series of hall nodes 91A–91N on each floor for managing all inputs and outputs on each floor, resulting in an improvement in economical efficiency of the overall elevator system operation.

Therefore, the network connecting each hall node 91A–91N is connected to the group management subnetwork 98 via the router 94 so that the group management subnetwork 98 may not be influenced even if a failure occurs in the network connecting the hall nodes 91A–91N.

To prevent the failure on each in-cage controller node 93A–93N or the failure on each elevator subnetwork 96A–96N from affecting an entire group management network, the elevator subnetwork 96A–96N and the hall subnetwork 97 are connected via the routers 94A–94N to ensure proper operation.

As described in detail above, according to the present invention, the I/O devices having a mutual relation are combined into one group and nodes are provided to be controlled in accordance with a small microprocessor, and the nodes are connected through the series network, and thereby the ***operation controller can be used in efficient management of the elevator system regardless of the number of the floors of the building.

According to the present invention, I/O devices that are mutually related are combined into one group and connected as a network, thereby removing a complicated wiring required in the conventional art to simplify the equipment, repairing and maintenance. The input and output operations are dispersed to each node and each elevator controller to be processed, thereby enhancing the efficiency of the elevator control system. ***

The present invention has an elevator control network connecting a hall node and a elevator node in each elevator to routers and has a separate group management network (NE) connecting the elevator nodes and the group management node, thereby preventing a mutual influence between an elevator control line and a group management communication line.

Further, the hall nodes in a conventional elevator control system were dispersed for each elevator, but the present invention has hall nodes on each floor that are combined in series, each hall node being connected with the group management subnetwork via a router, and the elevator subnetworks and the hall subnetworks are connected via the router to prevent a failure of one elevator or a failure on the network connecting hall nodes or a failure on the elevator subnetwork from affecting the entire group management network and thus enhancing operation reliability.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. An apparatus for efficiently managing a plurality of elevators in a group management apparatus having an in-cage controller node for registering a destination of the passengers boarding an elevator and indicating the present proceeding direction and location, a car controller node for controlling a motor and door in accordance with an operation sequence of an elevator, and a group management node for allocating the elevator according to a corresponding hall call to optimize operation efficiency of the entire elevator system, comprising:

a hall subnetwork serially connecting one hall node on each floor to the group management node;

an elevator subnetwork connecting the in-cage controller node and the car controller node in each elevator; and a router having a pair of communication CPUs connecting the elevator subnetwork to the hall subnetwork and an interface device to reciprocate signals through the communication CPUs, thereby logically/electrically separating the hall subnetwork from the elevator subnetwork.

2. An apparatus for efficiently managing a plurality of elevators in a group management apparatus having an in-cage controller node for registering a destination of the passengers boarding an elevator and indicating the present proceeding direction and location, a car controller node for controlling a motor and door in accordance with an operation sequence of the elevator, and a group management node for allocating an elevator according to a corresponding hall call to optimize operation efficiency of the entire elevator system, comprising:

a hall subnetwork serially connecting one hall node on each floor;

an elevator subnetwork connecting the in-cage controller node and the car controller node in each elevator;

a group management subnetwork connecting the group management node and each in-cage controller node;

a first router connecting the hall subnetwork to the elevator subnetwork; and a second router connecting the hall subnetwork to the group management subnetwork, wherein the first and second router include a pair of communication CPUs and an interface device to reciprocate signals through the communication CPUs.

* * * * *